US008393916B2

(12) United States Patent
Yu et al.

(10) Patent No.: US 8,393,916 B2
(45) Date of Patent: Mar. 12, 2013

(54) CARD-EDGE CONNECTOR AND CARD-EDGE CONNECTOR ASSEMBLY HAVING HEAT-RADIATING STRUCTURES

(75) Inventors: Wang-I Yu, Jhonghe (TW); Yung-Chih Hung, Jhonghe (TW); Hung-Chi Tai, Jhonghe (TW)

(73) Assignee: Alltop Electronics (Suzhou) Ltd., Taicang (CN)

( * ) Notice: Subject to any disclaimer, the term of this patent is extended or adjusted under 35 U.S.C. 154(b) by 181 days.

(21) Appl. No.: 13/022,436

(22) Filed: Feb. 7, 2011

(65) Prior Publication Data

US 2012/0164874 A1 Jun. 28, 2012

(30) Foreign Application Priority Data

Dec. 28, 2010 (CN) ..... 2010 1 0609641

(51) Int. Cl.
*H01R 13/00* (2006.01)

(52) U.S. Cl. ..... 439/485; 439/206

(58) Field of Classification Search ..... 439/206, 439/485

See application file for complete search history.

(56) References Cited

U.S. PATENT DOCUMENTS

| | | | | |
|---|---|---|---|---|
| 7,597,573 | B2 * | 10/2009 | Defibaugh et al. | 439/206 |
| 8,177,579 | B2 * | 5/2012 | Tai et al. | 439/485 |
| 8,303,331 | B2 * | 11/2012 | Yu et al. | 439/485 |
| 2010/0178809 | A1 | 7/2010 | Tsai | |

FOREIGN PATENT DOCUMENTS

| | | | |
|---|---|---|---|
| CN | 2289316 | Y | 8/1998 |
| CN | 201303171 | Y | 9/2009 |

* cited by examiner

*Primary Examiner* — Khiem Nguyen
(74) *Attorney, Agent, or Firm* — Sughrue Mion, PLLC

(57) ABSTRACT

A card-edge connector includes an insulative housing and a number of conductive contacts. The insulative housing defines a mating direction along a front-to-back direction and opposite front face and rear face. The insulative housing includes a pair of lengthwise walls, a central slot recessed from the front face along the front-to-back direction and at least one heat-radiating slot recessed from the front face along the front-to-back direction, and a number of contact-receiving passages in the lengthwise walls and communicating with the central slot. The heat-radiating slot is recessed from at least one of the pair of lengthwise walls and communicates with the contact-receiving passages along the mating direction. The conductive contacts are received in the contact-receiving passages.

20 Claims, 9 Drawing Sheets

CARD-EDGE CONNECTOR AND CARD-EDGE CONNECTOR ASSEMBLY HAVING HEAT-RADIATING STRUCTURES

BACKGROUND OF THE INVENTION

1. Field of the Invention

The present invention relates to a card-edge connector and a card-edge connector assembly, more particularly to a card-edge connector and a card-edge connector assembly for signal transmission.

2. Description of Related Art

Card-edge connectors are widely used today. In general, card-edge connectors can be classified into personal use and industrial use. When in personal use, card-edge connectors can be classified as desktop connectors, laptop connectors, mobile phone connectors, consuming connectors, and other types. Please refer to FIGS. 1-2, a card-edge connector 100' is usually mounted on a printed circuit board (PCB, not shown) and defines an interface for receiving an electrical card 200' to transmit signal and power. The card-edge connector comprises an insulative housing 1' and a plurality of contacts 3' contained in the insulative housing 1'. The insulative housing 1' defines a central slot 10' and two rows of contact-receiving passages 11' recessed in opposite lengthwise walls of the central slot 10'. The contacts 3' are respectively received in the contact-receiving passages 11' and partially exposed into the central slot 10' to form electrical connection with golden fingers 201' of the electrical card 200'.

When the electrical card 200' mates with the contacts 3', heat is generated because of impedance of conductors, that is contacts. If the heat cannot be radiated out of the insulative housing 1' of the card-edge connector 100' in time, the heat accumulated in the insulative housing 1' may cause different problems. For example, contacting portions of the contacts may produce carbon, melt, and excessive deformation etc. The insulative housing also may produce deformation, melt etc. Such phenomenon all can produce influence to reliability of signal or power transmission and use life of the card-edge connector.

Hence, it is disable to design a card-edge connector to address problems mentioned above.

BRIEF SUMMARY OF THE INVENTION

Accordingly, an object of the present invention is to provide a card-edge connector with improved heat-radiating structures to be more reliable.

Another object of the present invention is to provide a card-edge connector assembly with improved heat-radiating structures to be more reliable.

In order to achieve the above-mentioned object, a card-edge connector for electrically connecting with an electrical card comprises an insulative housing and a plurality of conductive contacts. The insulative housing defines a mating direction along a front-to-back direction and opposite front face and rear face. The insulative housing comprises a pair of lengthwise walls, a central slot recessed from the front face along the front-to-back direction and a heat-radiating slot recessed from the front face along the front-to-back direction, and a plurality of contact-receiving passages in the lengthwise walls and communicating with the central slot. The heat-radiating slot is recessed from at least one of the pair of lengthwise walls and communicates with the contact-receiving passages along the mating direction. The conductive contacts are received in said contact-receiving passages. Each conductive contact comprises a retaining portion retained in the insulative housing, a contacting portion extending from the retaining portion and extending into the central slot, and a connecting portion extending from the retaining portion beyond the insulative housing.

In order to achieve the above-mentioned object, a card-edge connector assembly comprises a card-edge connector and an electrical card. The card-edge connector comprises an insulative housing and a plurality of conductive contacts. The insulative housing defines a mating direction and opposite front face and rear face. The insulative housing comprises a pair of lengthwise walls, a central slot recessed from said front face along the mating direction and a plurality of contact-receiving passages in the lengthwise walls to communicate with the central slot. The conductive contacts are received in the contact-receiving passages and each conductive contact comprises a retaining portion retained in the insulative housing, a contacting portion extending from the retaining portion and partially into the central slot, and a connecting portion extending from the retaining portion and beyond the insulative housing. The electrical card comprises a main body and a plurality of golden fingers electrically connecting with the conductive contacts as the electrical card inserted into said central slot along the mating direction. At least one heat-radiating slot is formed between the main body of the electrical card and the opposite lengthwise walls and communicates with outside for radiating heat generated between the golden fingers and the conductive contacts.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
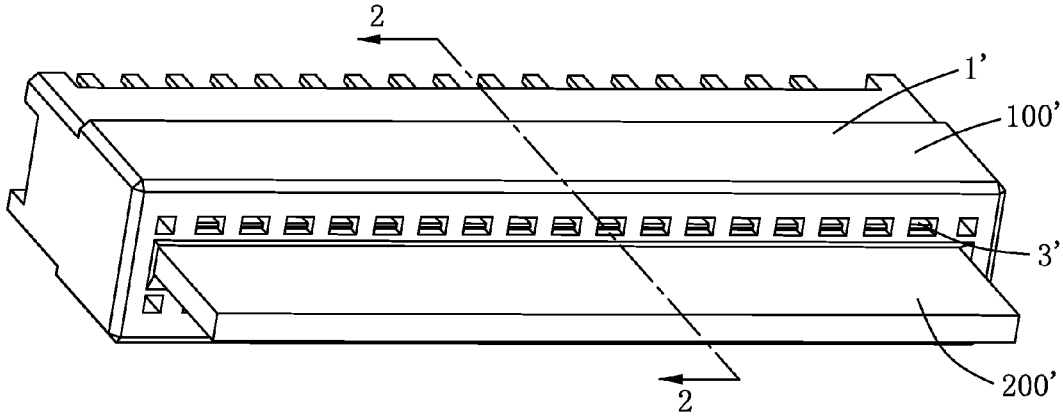
FIG. 1 (PRIOR ART)
FIG. 1 is an assembled, perspective view of a conventional card-edge connector assembly.
Figure 2:
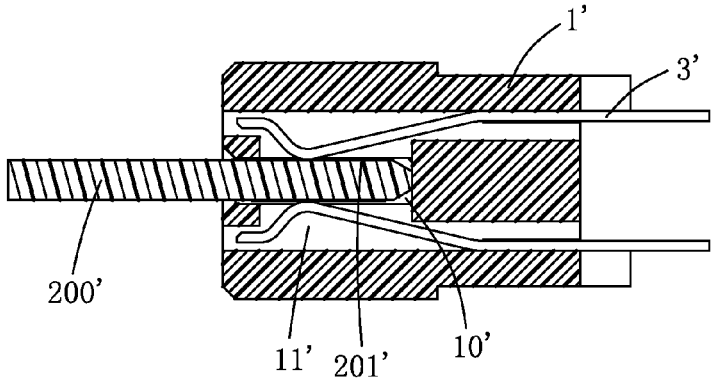
FIG. 2 (PRIOR ART)
FIG. 2 is a cross-sectional view taken along line 2-2 of FIG. 1.
Figure 3:
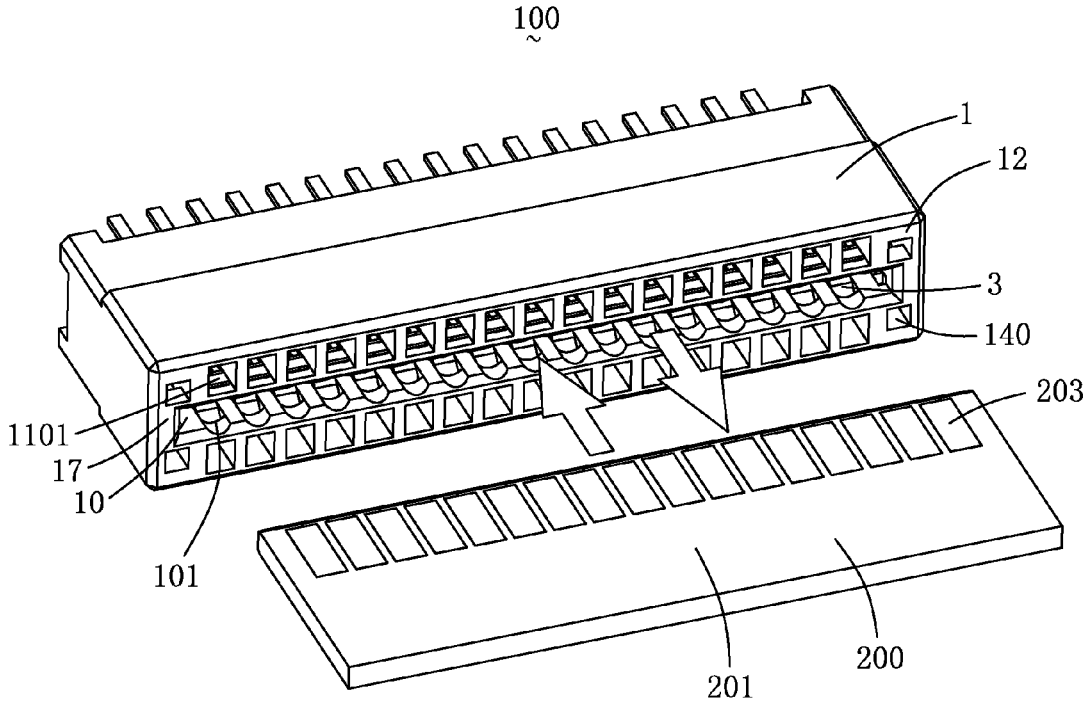
FIG. 3 is a perspective view of a card-edge connector assembly and an electrical card in accordance with the first embodiment of the present invention.
Figure 4:
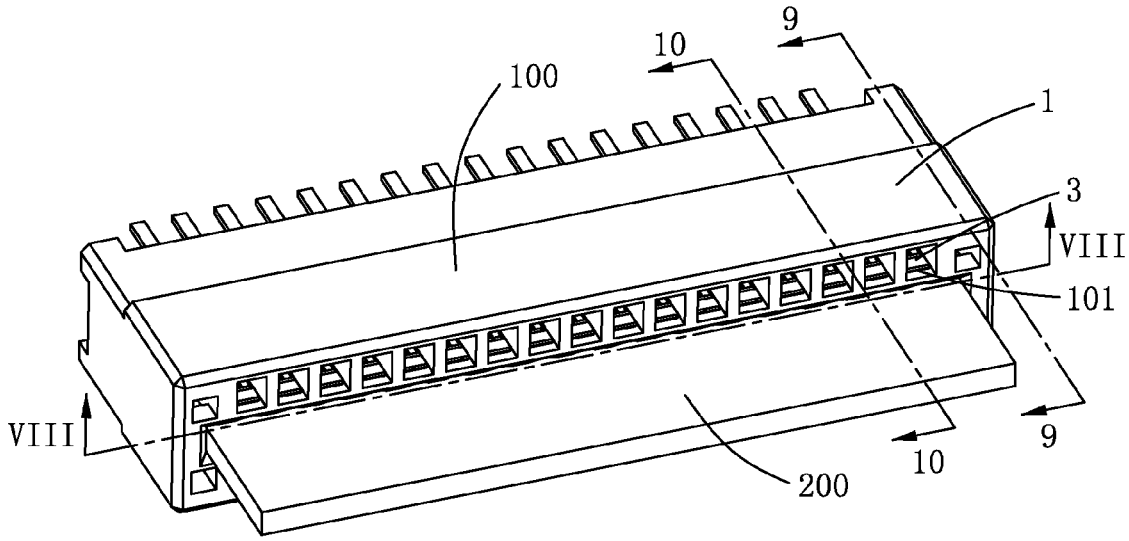
FIG. 4 is an assembled, perspective view of FIG. 3.
Figure 5:
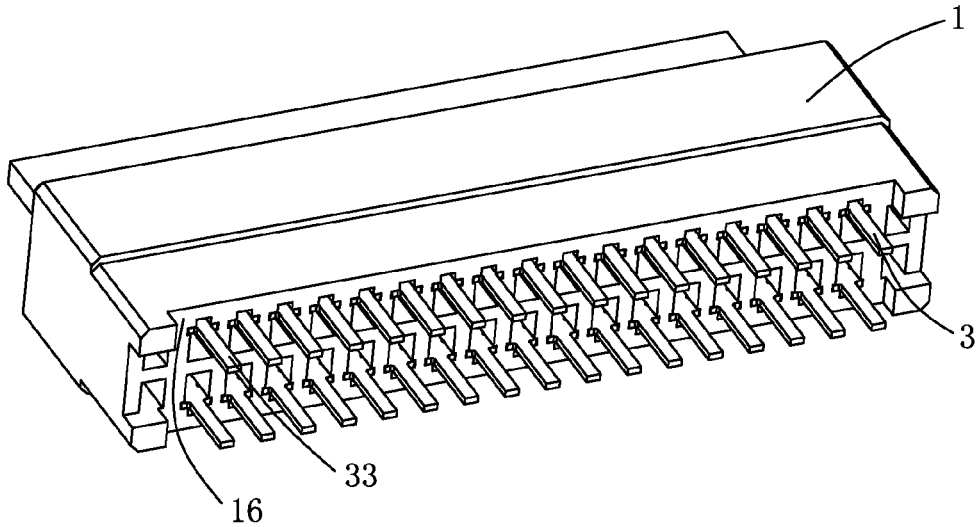
FIG. 5 a view similar to FIG. 4, but viewed from a different angle.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 3-7, a card-edge connector 100 in accordance with the first embodiment of the present invention comprises an insulative housing 1 and two rows of conductive contacts 3 received in the insulative housing 1. An electrical card 200 mates with the card-edge connector 100 to form a card-edge connector assembly and comprises a main body 201 and a plurality of golden fingers 203 arranged on opposite sides of the main body 201. The golden fingers 203 and the conductive contacts 3 form electrical connection therebetween when the card-edge connector 100 mates with the electrical card 200 for signal transmission.

Please refer to FIGS. 4-11, the insulative housing 1 is elongated and defines a mating direction extending along front-to-back direction and opposite front face 12 and rear face 16. The insulative housing 1 comprises opposite lengthwise walls 103, a central slot 10 recessed inwardly from the front face 12 along the mating direction, a plurality of contact-receiving passages 11 recessed in the opposite lengthwise walls 103, and a plurality of first heat-radiating slots 101 recessed inwardly from the front face 12 along the mating direction. Each first heat-radiating slot 101 can be square shape or arc shape. The contact-receiving passage 11 comprises a front section 110 for receiving a contacting portion 31 of the conductive contact 3 and a rear section 112 for receiving a retaining portion 32 of the conductive contact 3. The front section 110 of the contact-receiving passage 11 communicates with the central slot 10 and the front face 12. The rear section 112 of the contact-receiving passage 11 communicates with the rear face 16. Thus, the front section 110, the rear section 112 and the central slot 10 communicate with one another. The first heat-radiating slot 101 communicates with respective front section 110 along the mating direction.

The insulative housing 1 defines a plurality of openings 1101 recessed inwardly from the front face 12 and each opening 1101 is located above or below corresponding contact-receiving passage 11 and communicates with the contact-receiving passage 11. A plurality of second heat-radiating slots 1121, 1122 recessed forwardly from the rear face 16 and respectively located above and below the second section 112 of the contact-receiving passage 11 to communicate with the first section 110. The second heat-radiating slot 1122 also communicates with the central slot 10. Also the insulative housing 1 forms a supporting rib 105 between the opening 1101 and the first heat-radiating slot 101 for supporting a free end 312 of the contact 3.

Figure 6:
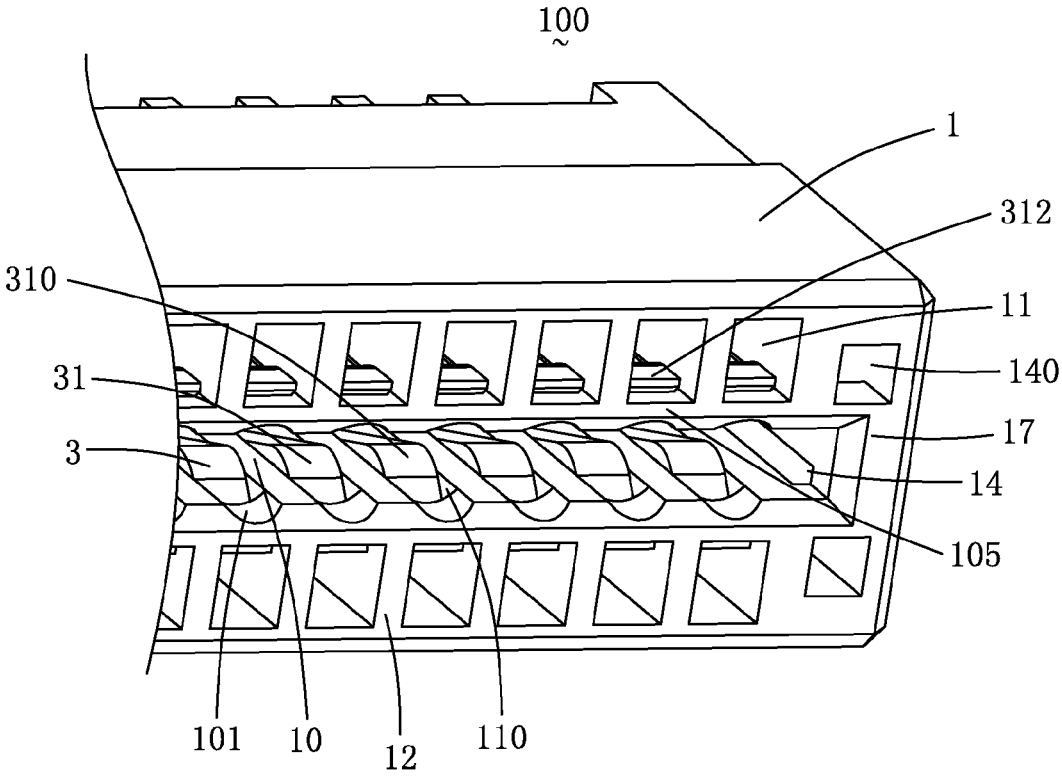
FIG. 6 is a partially enlarged view of the card-edge connector in accordance with the first embodiment of the present invention.
Figure 7:
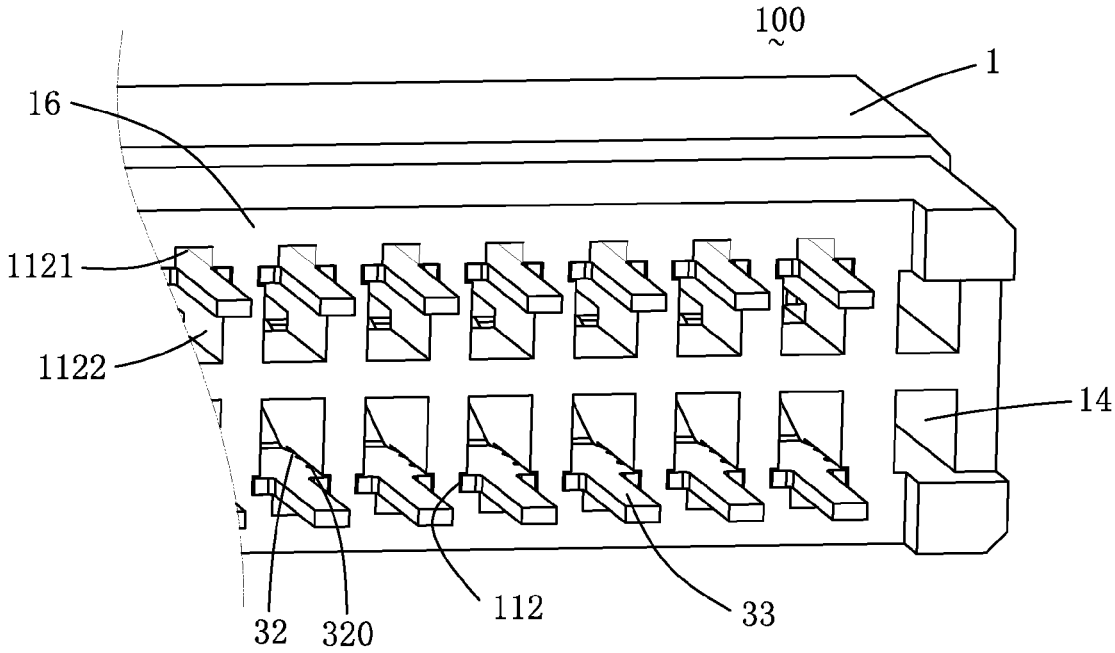
FIG. 7 is a view similar to FIG. 6, but viewed from a different angle.

An additional heat-radiating slot 14 is defined in each end section 17 of the insulative housing 1 and communicates with the central slot 10. As shown in FIGS. 6-7, the additional heat-radiating slot 14 penetrates through the front face 12 and the rear face 16. The additional heat-radiating slot 14 communicates with the front face 12 via a recess 140.

Please refer to FIGS. 6-10, in the first embodiment of the present invention, the conductive contact 3 comprises the flat retention portion 32 extending along the mating direction, the mating portion 31 curved forwardly from the retention portion 32 and a connecting portion 33 extending flatly from the retention portion 32. A plurality of barbs 320 is formed at opposite sides of the retention portion 32. The mating portion 31 is curved downwardly firstly from the retention portion 32 and then upwardly to form an elastic spring arm 310 with the free end 312.

When assembling the contacts 3 into the insulative housing 1, the mating portions 31 are received in the first sections 110 of the contact-receiving passages 11, the retention portions 32 are received in the second sections 112 of the contact-receiving passages 11 with the barbs 320 interferentially engaged with inner walls of the second sections 112, and the connecting portions 33 extend beyond the rear face 16 for electrically connecting with a PCB (not shown). The elastic spring arms 310 extend beyond the first sections 110 to be exposed in the central slot 10 while the free ends 312 enters in the openings 1101 and is supported by the supporting rib 105.

Figure 8:
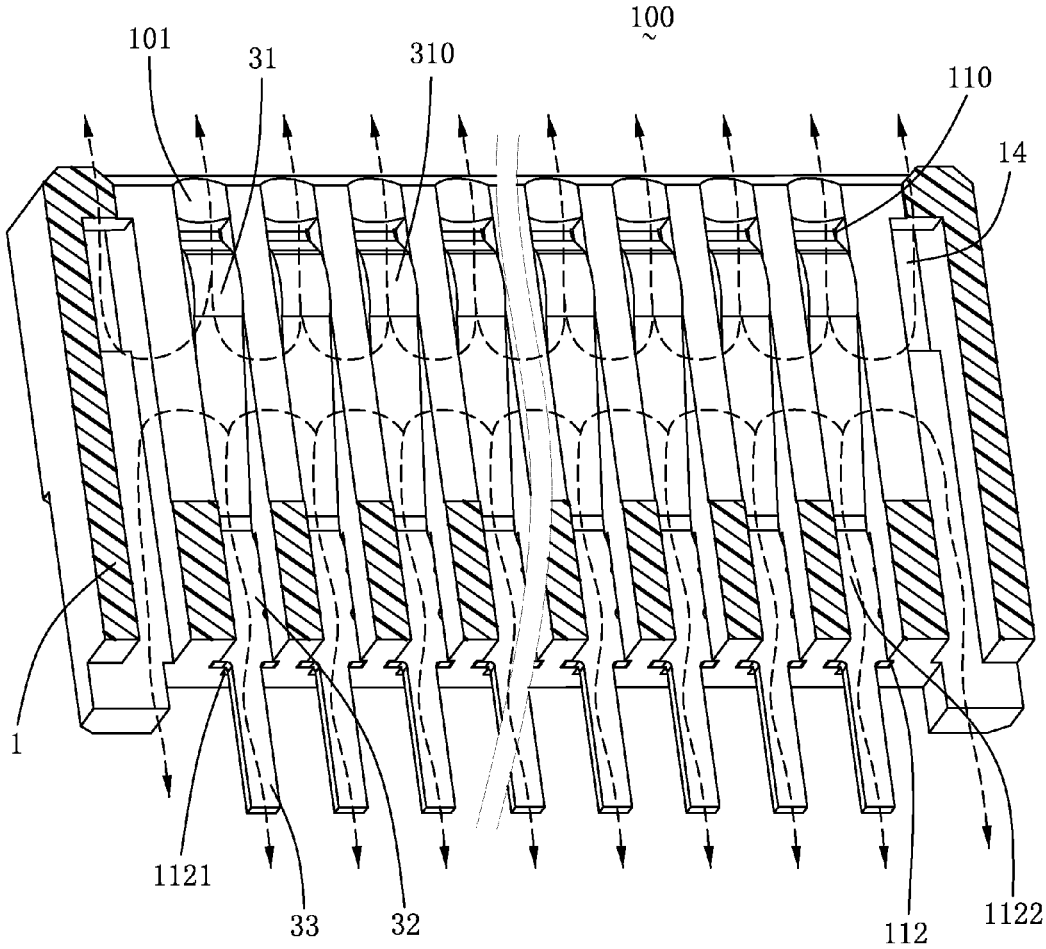
FIG. 8 is a cross-section view taken along line 8-8 of FIG. 4.
Figure 9:
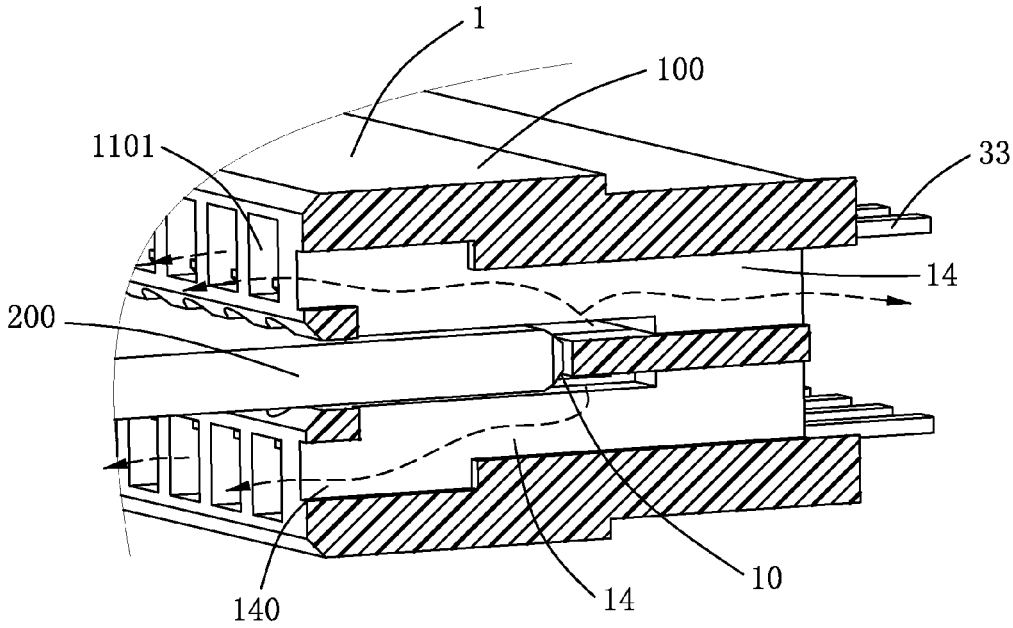
FIG. 9 is a cross-section view taken along line 9-9 of FIG. 4.
Figure 10:
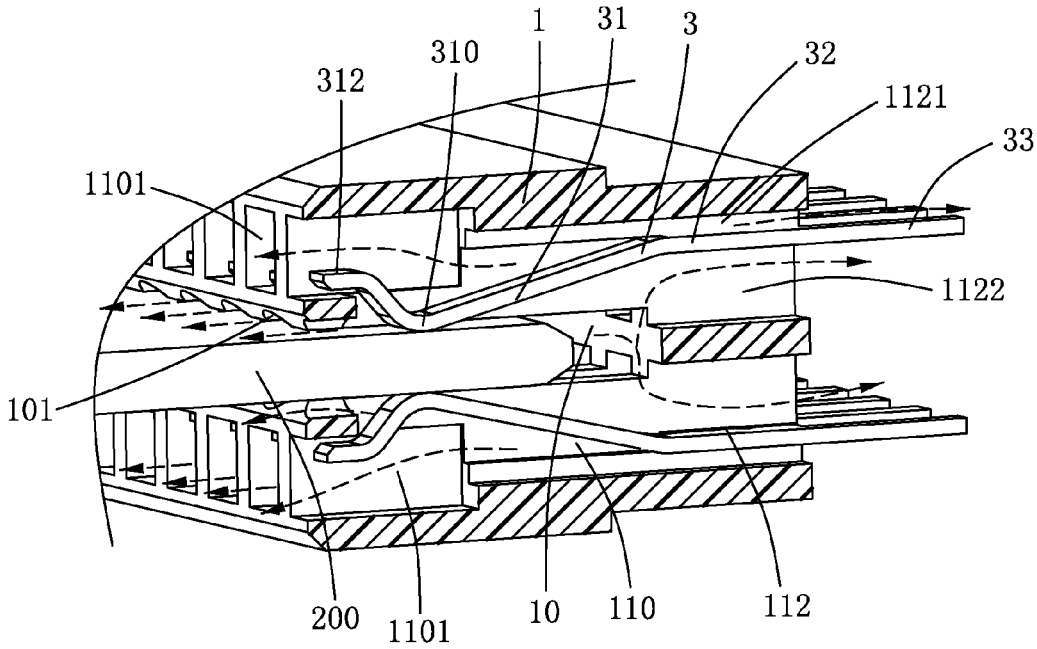
FIG. 10 is a cross-section view taken along line 10-10 of FIG. 4.

When the electrical card 200 is inserted into the central slot 10, the end with the golden fingers 203 is received in the central slot 10 with the golden fingers 203 contact the elastic spring arms 310 to form electrical connection. Heat is also generated between the golden fingers 203 and the elastic spring arms 310. FIGS. 8-10 illustrate how the heat is radiated out from the insulative housing 1 with the arrows. The heat generated before the contacting area between the golden fingers 203 and the conductive contacts 3 is radiated out via the first heat-radiating slot 101, the additional heat-radiating slot 14, the recesses 140, and the openings 1101. The heat generated behind the contacting area between the golden fingers 203 and the conductive contacts 3 is radiated out via the additional heat-radiating slots 14, and the second heat-radiating slots 1121, 1122.

In the first embodiment of the present invention, the additional heat-radiating slots 14 penetrate through both the front face 12 and the rear face 16. However, in an alternative embodiment, the additional heat-radiating slots 14 can only penetrate through one of the front face 12 and the rear face 16.

Figure 11:
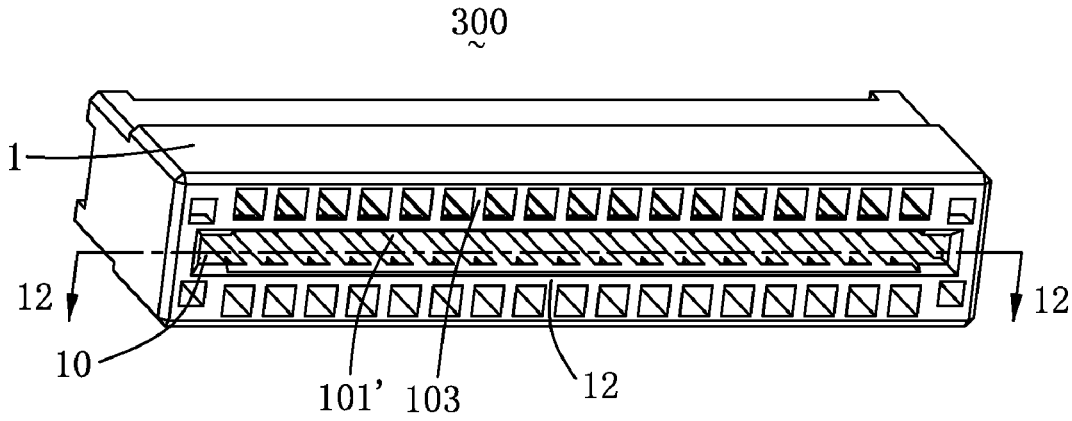
FIG. 11 is a perspective view of an insulative housing of a card-edge connector in accordance with the second embodiment of the present invention.
Figure 12:
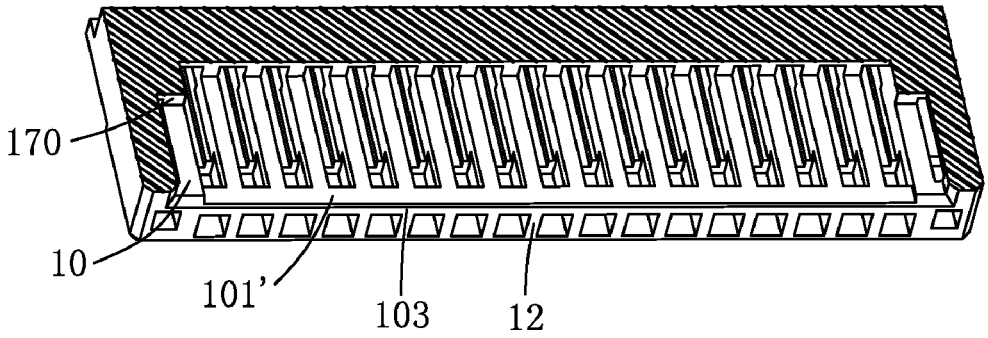
FIG. 12 is a cross-section view taken along line 12-12 of FIG. 11.

Please refer to FIGS. 11 and 12, a card-edge connector 300 in accordance with the second embodiment of the present invention is shown. Compared with the insulative housing 1 of the first embodiment, the insulative housing 1 of the card-edge connector 300 enlarges the central slot 10 upwardly and downwardly except the central slot 10 in the end sections 17 to form a pair of first heat-radiating slots 101' communicating with the central slot 10. Please refer to FIG. 12, a pair of blocking sections 170 is formed at rear section of the end sections 17 for blocking the electrical card 200 from inserting into the insulative housing 1 too deeply. Hence, when the electrical card 200 mates with the card-edge connector 300, the electrical card 200 is guided by the central slot 10 at the two opposite end sections 17 until blocked by the blocking sections 170. Thus, space is formed between the lengthwise walls 103 and opposite upper and lower surfaces of the electrical card 200. The heat generated between the electrical card 200 and the card-edge connector 300 is radiated out through the first radiating slots 101'.

Figure 13:
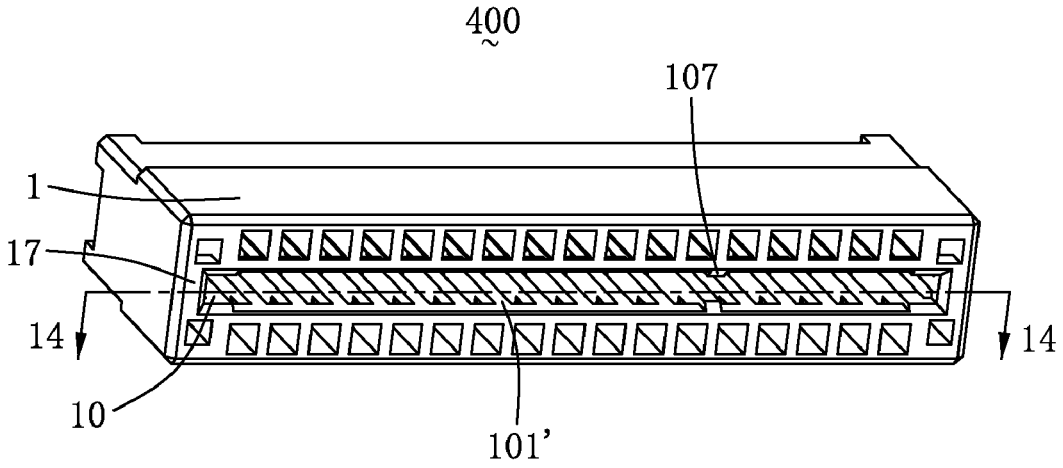
FIG. 13 is a perspective view of an insulative housing of a card-edge connector in accordance with the third embodiment of the present invention.
Figure 14:
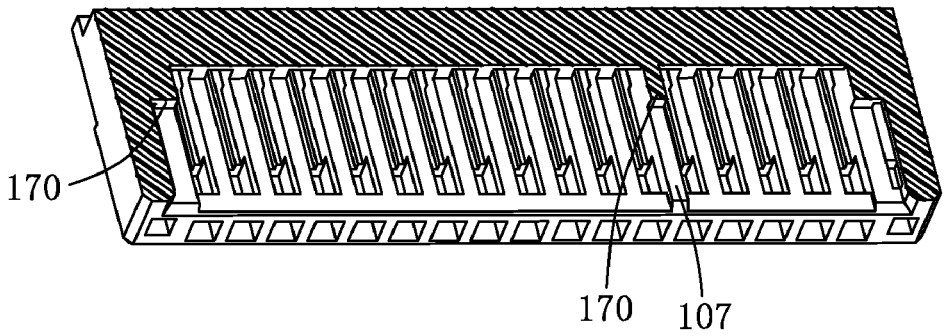
FIG. 14 is a cross-section view taken along line 14-14 of FIG. 13.

Please refer to FIGS. 13 and 14, a card-edge connector 400 in accordance with the third embodiment of the present invention is shown. Compared with the insulative housing 1 of the card-edge connector 300 of the second embodiment, a pair of protruding ribs 107 protrudes upwardly and downwardly from the lengthwise walls 103 toward the first heat-radiating slots 101'. The height between the pair of protruding ribs 107 is same as that of the central slot 10, thus, the electrical card 200 can be guided and supported by the pair of protruding ribs 107. A blocking section 170 is also formed behind each protruding rib 107 to restrict the insertion depth of the electrical card 200 together with the other blocking sections 170.

Figure 15:
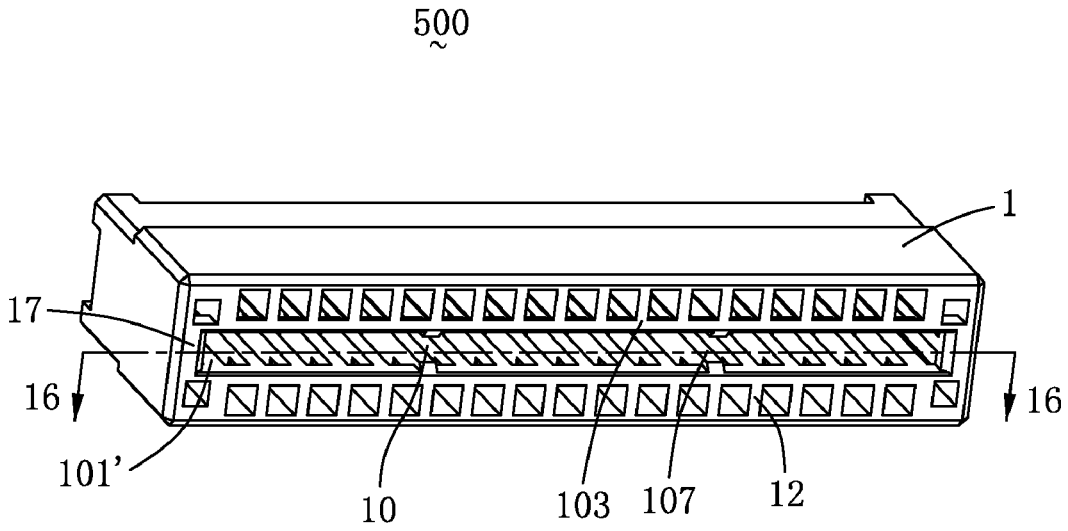
FIG. 15 is a perspective view of an insulative housing of a card-edge connector in accordance with the fourth embodiment of the present invention.
Figure 16:
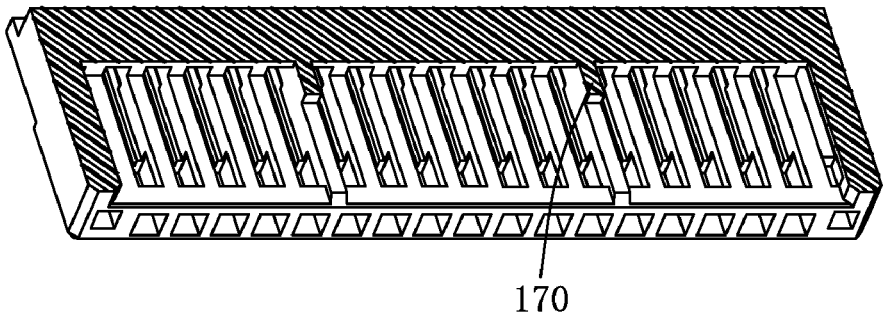
FIG. 16 is a cross-section view taken along line 16-16 of FIG. 15.

Please refer to FIGS. 15 and 16, a card-edge connector 500 in accordance with the fourth embodiment of the present invention is shown. Compared with the insulative housing 1 of the card-edge connector 300 of the second embodiment, the whole lengthwise walls 103 are cutoff to form the pair of first radiating slots 101' communicating with the central slot 10. Two pairs of protruding ribs 107 respectively protrude from the opposite lengthwise walls 103. The height between each pair of protruding ribs 107 is also equal to that of the central slot 10. Hence, when the electrical card 200 is inserted into the card-edge connector 500, the electrical card 200 is guided and supported by the two pairs of protruding ribs 107 and blocked by the rear blocking sections 170. Via the space formed between the first heat-radiating slots 101' and the electrical card 200, the heat generated is radiated out.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A card-edge connector, adapted for electrically connecting with an electrical card, comprising:

an insulative housing defining a mating direction along a front-to-back direction and opposite front face and rear face, the insulative housing comprising a pair of lengthwise walls, a central slot recessed from the front face along said front-to-back direction and a heat-radiating slot recessed from the front face along said front-to-back direction, and a plurality of contact-receiving passages in the lengthwise walls and communicating with the central slot, said heat-radiating slot recessed from at least one of the pair of lengthwise walls and communicating with the contact-receiving passages along said mating direction; and a plurality of conductive contacts received in said contact-receiving passages, each conductive contact comprising a retaining portion retained in the insulative housing, a contacting portion extending from the retaining portion and extending into the central slot, and a connecting portion extending from the retaining portion beyond the insulative housing.

2. The card-edge connector as claimed in claim 1, wherein the heat-radiating slot is a plurality of heat-radiating slots recessed upwardly and downwardly from both the lengthwise walls.

3. The card-edge connector as claimed in claim 2, wherein each heat-radiating slot aligns with corresponding contact-receiving passage along said mating direction.

4. The card-edge connector as claimed in claim 1, wherein the insulative housing comprises a pair of end sections at opposite ends of the lengthwise walls, and wherein said heat-radiating slot communicates with the central slot and extends along the extending direction of the lengthwise wall between the pair of end sections.

5. The card-edge connector as claimed in claim 4, wherein the insulative housing forms a pair of blocking sections protruding into the central slot at rear section of the end sections for blocking the insertion depth of the electrical card.

6. The card-edge connector as claimed in claim 4, wherein the pair of lengthwise walls form a pair of protruding ribs protruding into the heat-radiating slot, and wherein the height between the pair of protruding ribs is equal to that of the central slot.

7. The card-edge connector as claimed in claim 4, wherein the insulative housing defines an additional heat-radiating slot in each end section, and wherein the additional heat-radiating slot penetrates through at least one of the front face and the rear face and communicates with the central slot.

8. The card-edge connector as claimed in claim 1, wherein the contact-receiving passage comprises a front section receiving the contacting portion of the conductive contact, and a rear section receiving the retaining portion of the conductive contact, and wherein insulative housing defines a plurality of openings recessed from the front face along said mating direction and respectively communicating with the first sections of the contact-receiving passages.

9. The card-edge connector as claimed in claim 8, wherein the contacting portion of each conductive contact forms a free end protruding into the opening.

10. The card-edge connector as claimed in claim 8, wherein the insulative housing defines a plurality of second heat-radiating slots in pairs, and wherein each pair of heat-radiating slots locates above and below corresponding second section of the contact-receiving passage and communicates with the second section and the central slot.

11. A card-edge connector assembly comprising:

a card-edge connector comprising:

an insulative housing defining a mating direction and opposite front face and rear face, the insulative housing comprising a pair of lengthwise walls, a central slot recessed from said front face along the mating direction and a plurality of contact-receiving passages in the lengthwise walls to communicate with the central slot;

a plurality of conductive contacts received in the contact-receiving passages and each conductive contact comprising a retaining portion retained in the insulative housing, a contacting portion extending from the retaining portion and partially into the central slot, and a connecting portion extending from the retaining portion and beyond the insulative housing; and an electrical card comprising a main body and a plurality of golden fingers electrically connecting with the conductive contacts as the electrical card inserted into said central slot along said mating direction; and wherein at least one heat-radiating slot is formed between the main body of the electrical card and the opposite lengthwise walls and communicates with outside for radiating heat generated between the golden fingers and the conductive contacts.

12. The card-edge connector assembly as claimed in claim 11, wherein the heat-radiating slot is recessed from at least one of the lengthwise wall and communicates with the central slot.

13. The card-edge connector assembly as claimed in claim 12, wherein the heat-radiating slot is a plurality of heat-radiating slots recessed upwardly and downwardly from the pair of lengthwise walls respectively, and wherein each heat-radiating slot aligns with the contact-receiving passage along said mating direction.

14. The card-edge connector assembly as claimed in claim 12, wherein the insulative housing comprises a pair of end sections at opposite ends of the lengthwise walls, and wherein said heat-radiating slot communicates with the central slot and the heat-radiating slot extends along the extending direction of the lengthwise wall between the pair of end sections.

15. The card-edge connector assembly as claimed in claim 14, wherein the insulative housing forms a pair of blocking sections protruding into the central slot at rear part of the end sections for blocking the insertion depth of the electrical card.

16. The card-edge connector as claimed in claim 14, wherein the pair of lengthwise walls form a pair of protruding ribs protruding into the heat-radiating slot, and wherein the height between the pair of protruding ribs is equal to that of the central slot.

17. The card-edge connector as claimed in claim 14, wherein the insulative housing defines an additional heat-radiating slot in each end section, and wherein the additional heat-radiating slot penetrates through at least one of the front face and the rear face and communicates with the central slot.

18. The card-edge connector as claimed in claim 17, wherein the contact-receiving passage comprises a front section receiving the contacting portion of the conductive contact, and a rear section receiving the retaining portion of the conductive contact, and wherein insulative housing defines a plurality of openings recessed from the front face along said mating direction and respectively communicating with the first sections of the contact-receiving passages.

19. The card-edge connector assembly as claimed in claim 18, wherein the heat generated between the golden fingers of the electrical card and the conductive contacts is radiated out from the front face via the additional heat-radiating slots, the first sections of the contact-receiving passages and the openings communicating with the first sections, and the heat-radiating slot between the electrical card and the lengthwise walls.

20. The card-edge connector assembly as claimed in claim 17, wherein the heat generated between the golden fingers of the electrical card and the conductive contacts is radiated out from the rear face via the second sections of the contact-receiving passages and the additional heat-radiating slots.

* * * * *